United States Patent [19]

Hill et al.

[11] Patent Number: 4,784,341

[45] Date of Patent: Nov. 15, 1988

[54] TEXTILE YARN WINDING APPARATUS

[75] Inventors: Grenville M. Hill, Antrim; William J. McDonald, Down, both of Ireland

[73] Assignee: James Mackie & Sons Ltd., United Kingdom

[21] Appl. No.: 68,257

[22] Filed: Jun. 30, 1987

Related U.S. Application Data

[63] Continuation-in-part of Ser. No. 762,558, Aug. 5, 1985, abandoned.

[30] Foreign Application Priority Data

Aug. 20, 1984 [GB] United Kingdom ..... 8421129

[51] Int. Cl.[4] ..... B65H 67/056

[52] U.S. Cl. ..... 242/18 A; 242/19; 242/25 A

[58] Field of Search ..... 242/18 A, 25 A, 19

[56] References Cited

U.S. PATENT DOCUMENTS

| | | | |
|---|---|---|---|
| 2,296,339 | 9/1942 | Daniels | 242/18 A X |
| 2,600,841 | 6/1952 | Bruestle | 242/25 A X |
| 2,932,462 | 4/1960 | Nelson | 242/25 A |
| 3,064,912 | 11/1962 | Bittman | 242/25 A |
| 3,086,721 | 4/1963 | Duff | 242/25 A |
| 3,169,715 | 2/1965 | Ludwig | 242/25 A |
| 3,174,700 | 3/1965 | Lemaire | 242/18 A |
| 3,368,765 | 2/1968 | O'Grady | 242/25 A |
| 3,408,013 | 10/1968 | Hauck et al. | 242/25 A |
| 3,823,885 | 7/1974 | De Schulthess | 242/18 A |
| 4,103,835 | 8/1978 | List | 242/18 A |
| 4,111,376 | 9/1978 | Hoddinott et al. | 242/25 A |
| 4,291,841 | 9/1981 | Dalrymple et al. | 242/18 A |

FOREIGN PATENT DOCUMENTS

| | | | |
|---|---|---|---|
| 1203532 | 8/1959 | France | 242/18 A |
| 1100358 | 1/1968 | United Kingdom | 242/25 A |
| 1308835 | 3/1973 | United Kingdom | 242/18 A |

*Primary Examiner*—Stanley N. Gilreath

*Attorney, Agent, or Firm*—Wood, Herron & Evans

[57] ABSTRACT

A textile yarn winding apparatus for winding a continuously produced yarn, said apparatus being of the type having spindles carrying two axially aligned flanged bobbins and a yarn guide which is reciprocated along the length of one or other of the flanged bobbins so as to lay yarn wherein the yarn guide may be moved from its path along the length of one bobbin to a corresponding path along the length of a second bobbin when it is desired to transfer the winding from one bobbin to another, whereby the take-up of the yarn continues without interruption, the yarn being led from the surface of the completed bobbin over the adjacent flanges of the completed and empty bobbins to the barrel of the empty bobbin thus connecting the two. Yarn severing means is arranged to engage that part of the connecting yarn which extends at an angle between the flange and barrel of the empty bobbin so as to sever it but not before the yarn guide has been driven in the direction of the flange of the empty bobbin adjacent the completed bobbin. This ensures that when transferring yarn from a completed bobbin to an empty bobbin, the tail of the yarn left on the empty bobbin after severing is kept to a manageable length and the initial winding of the yarn on the empty bobbin is tightly and securely wrapped around the barrel thereof.

17 Claims, 5 Drawing Sheets

TEXTILE YARN WINDING APPARATUS

RELATED APPLICATION

This application is a continuation-in-part of application Ser. No. 762,558, filed Aug. 5, 1985, now abandoned.

BACKGROUND OF INVENTION

This invention relates to textile yarn winding apparatus and in particular to a yarn winder which includes a yarn laying mechanism which may, for example, be in the form of a traverse guide screw and a yarn guide which is caused by engagement of a follower with the screw, to reciprocate or traverse along the length of a yarn package, e.g. a bobbin, to lay yarn evenly on the surface of the package. The yarn guide may be driven in other ways such as by a scroll, cam, belt, chain or the like. By the term "yarn" we wish to include natural and synthetic yarns, filaments, wire and the like.

It is desirable automatically to transfer yarn being wound from a full bobbin to an empty bobbin lying on the same axial plane without stopping the winding. This is particularly important when a yarn or filament is being delivered to the winder continuously at a controlled rate, e.g. directly from an extruder.

When yarn is being transferred from a full bobbin to an empty bobbin the yarn has to pass over the adjacent flanges of the two bobbins and then be wrapped around the barrel of the empty bobbin. The connecting yarn length is then severed so that the full bobbin may be doffed.

It is known to sever the yarn connecting the completed and empty bobbin between adjacent flanges of the two bobbins but this can result in a long unmanageable tail of yarn extending from the barrel of the empty bobbin which will whip around uncontrollably and become entangled with parts of the winder or entangled with the yarn being traversed along the bobbin so as to render normal winding impossible and cause yarn snarls and stoppages when the yarn is being unwound from the bobbin at the next processing stage. The problem can be further exacerbated if on transfer of the yarn from the full to the empty bobbin, the initial windings are not tightly and securely wrapped around the barrel of the empty bobbin. In order to control this long tail during winding and hold it to enable the initial windings to be tight on the barrel of the empty bobbin, specially designed extensions around which the tail of the yarn is wrapped and locked, have been provided on the bobbin flanges or have been mounted separately on the spindle to abut against the bobbin flange but these, in themselves, can cause other problems when doffing and/or transporting the full bobbins to the next processing stage.

OBJECTS AND BRIEF DESCRIPTION OF THE INVENTION

The purpose of the present invention is to ensure that on transfer of the yarn from a full bobbin to an empty bobbin, the tail of the yarn left on the empty bobbin after severing is kept to a manageable length and that the initial windings of the yarn on the empty bobbin are tightly and securely wrapped around the barrel thereof in order to trap the tail end of the yarn filament.

This is achieved in accordance with the invention in a winder which comprises rotatably driven mounting means for mounting for rotation each of two axially aligned flanged bobbins, a yarn guide which is caused to reciprocate along the length of one or other of the flanged bobbins to be wound so as to lay the yarn on that bobbin, means to move the yarn guide from its reciprocal path along the length of said one bobbin to a corresponding reciprocal path along the length of the said other bobbin when it is desired to transfer the winding from one bobbin to another, the yarn being thus led from the wound bobbin over the adjacent flanges of the wound and the empty bobbin to the barrel of the empty bobbin, displaceable yarn severing means to sever the yarn which connects the wound and empty bobbins, actuating means for actuating the yarn severing means and means for controlling the said actuating means whereby the actuating means is operated only after the winding has been transferred from one of the said bobbins to the other and the first turns on the other bobbin have been overlaid by later turns of the yarn resulting from a reciprocal movement of the yarn guide.

Preferably the yarn severing means is arranged to engage that part of the connecting yarn which extends at an angle between the flange and the barrel of the empty bobbin.

This means that the length of yarn stretching at an angle from the flange of the empty bobbin to the barrel is securely held and prevented from slipping back against the face of the flange, so as to position it for severing, and after severing the initial windings of the yarn on the barrel of the empty bobbin will remain tight and not slip to an extent that would result in a long unmanageable tail extending from the bobbin.

The yarn transfer mechanism preferably includes means to ensure that the yarn guide after its initial movement to transfer the yarn from the full bobbin to the empty bobbin lays yarn on the barrel of the empty bobbin whilst moving towards the flange of the empty bobbin which is adjacent to and aligned with the flange of the full bobbin so as to quickly overlap that end of the angled piece of connecting yarn where it meets the barrel of the empty bobbin so as to cause it to be sufficiently taut for easy severing and to prevent it from unwinding from the barrel or from causing the windings to slacken, after severing. Furthermore the position of the severing device relative to the angled piece of yarn and to the flange from which it passes to the barrel of the empty bobbin is such as to result in the length of that tail of yarn being buried underneath the windings as the yarn guide continues to lay the yarn right up to that flange.

Means are provided to retain the yarn/filament on the periphery of the adjacent bobbin flanges during the initial movement of the guide and during severing. Otherwise if it is allowed to slip around the flanges it will unwind from the full bobbin. The means to hold the yarn in position on the flanges may, for example, be a slot or slots in each of the two flanges, a circular brush or, preferably, a circular toothed disc of rubber or plastics positioned between the two flanges the teeth of which extend around and beyond the flange diameter. The yarn is thus restrained by the teeth on the flange to at least the flange of the empty bobbin.

The toothed disc is mounted for rotation with the bobbins and preferably interlocks with a flange of one or other, of the two bobbins.

In the preferable construction, the means to ensure that the yarn guide starts to lay yarn on the barrel of the relatively empty bobbin in a direction towards the flange of the empty bobbin adjacent that of the full bobbin, may comprise a switch which is actuated by movement of the yarn guide and which causes the yarn guide to lower to its yarn laying position from a raised position, which is required to enable the guide to clear the adjacent flanges of the bobbins. At about the same time the switch activates the means to reciprocate the yarn guide, to drive that guide in the desired direction.

Other objects and features of the invention will be apparent from the following description given by way of example with reference to the accompanying drawings.

BRIEF DESCRIPTION OF THE DRAWINGS

Referring to FIG. 1, the yarn being wound is nylon monofilament and the yarn laying mechanism of the winder comprises a yarn guide generally indicated at 2 which is caused to reciprocate along a driven screw 4 within a traverse box 5, by a screwed block follower 6 in the form of a half nut which lies on the top half of the screw 4. The follower is also mounted to slide along a guide rod 7 on which it is free to pivot.

Figure 1:
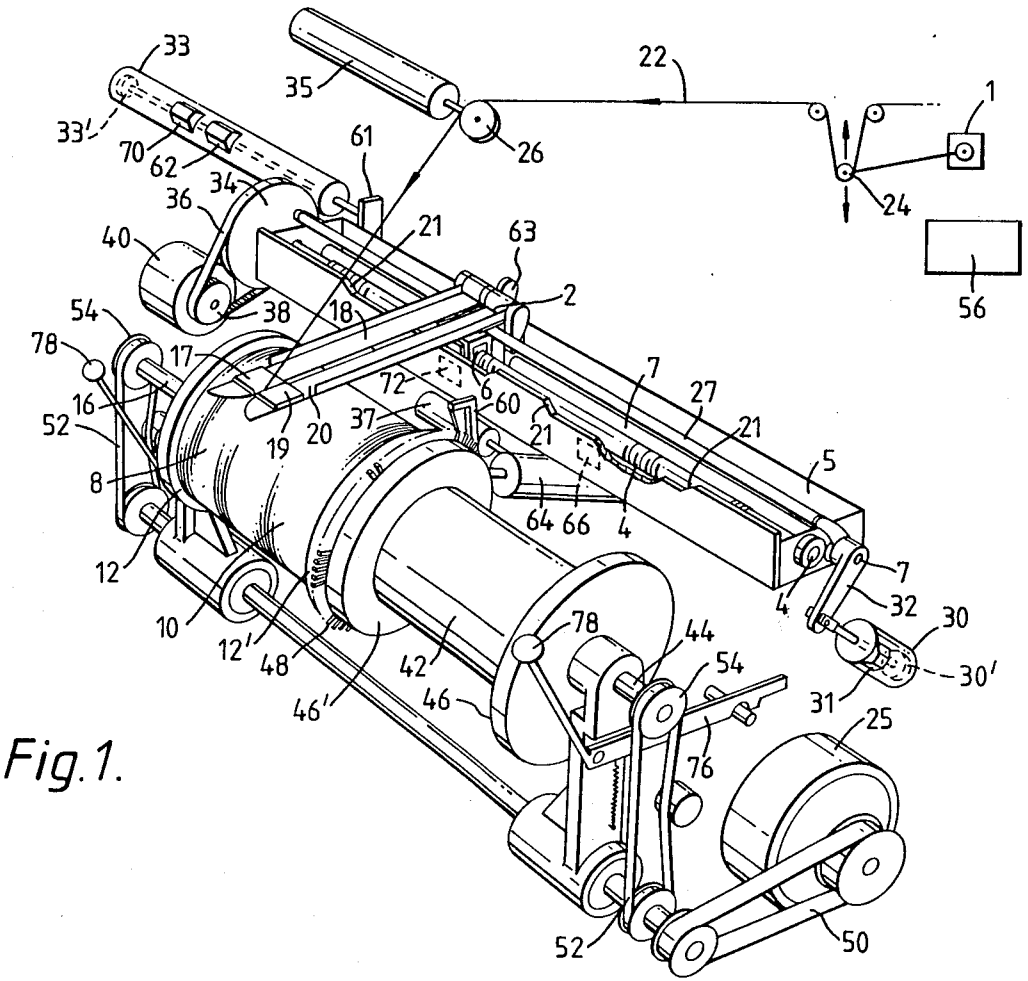
FIG. 1 is a perspective view of a textile yarn winding machine in accordance with the invention at a position in which yarn is being wound onto a first bobbin.

The guide 2 reciprocates along a yarn package 8 being wound on a bobbin 10 provided with flanges 12, 12' and mounted on a spindle 16. As can be seen in the drawings, the guide is formed of two fingers 18, 20 each pivoted separately on the follower 6. The fingers 18, 20 can thus each hinge upwardly to accommodate the growth of the package.

The direction of rotation of the screw 4 is reversed by operation of a micro switch 17, 19 on guide fingers 18, 20 respectively as the guide fingers reach the respective flanges of the bobbin and the relatively leading finger pivots up over the then adjacent flange by engagement with a respective cam surface 21 formed on the edge of the traverse box 5 so that the yarn is controlled right up to the flange by the trailing finger 18 or 20, depending on the traverse direction. Such an arrangement is described and claimed in the specification of British Patent No. 2127860, the proprietors of which are the assignees of the present application.

In use the yarn 22 is delivered at a controlled rate from an extruder (not shown) and passes around a set of pulleys including a "dancing pulley" 24, the vertical movement of which serves to regulate the torque of the eddy current coupling 25 driving the spindle 16 so as to compensate for the increase in diameter of the package as it is wound in order to maintain a substantially constant tension of the filament throughout the winding of the package The yarn then passes over a guide pulley 26 and passes between the yarn guide fingers 18, 20 to be laid on the package.

A lifting bar 27 is positioned above the screw 4 and beneath the fingers 18, 20. The bar 27 is pivotally mounted on the guide rod 7 and can be raised and lowered relative to the box by operation of a pneumatic piston-cylinder 30 acting through a lever 32.

The screw 4 is driven by an electric motor 40 which changes direction when the trailing finger of the guide 2 reaches a flange of the bobbin and operates the micro switch 17, 19 to reverse the direction of rotation of the screw and hence the direction of movement of the yarn guide.

A second bobbin 42 is mounted in axial alignment with the bobbin 10 on a second driven spindle 44. One flange, 46', of the two flanges 46, 46' of the bobbin 42 is positioned closely adjacent to a flange 12' of the bobbin 10 and is separated therefrom by a toothed rubber disc 48 positioned between the two flanges and connected for rotation with one of the flanges.

Figure 5:
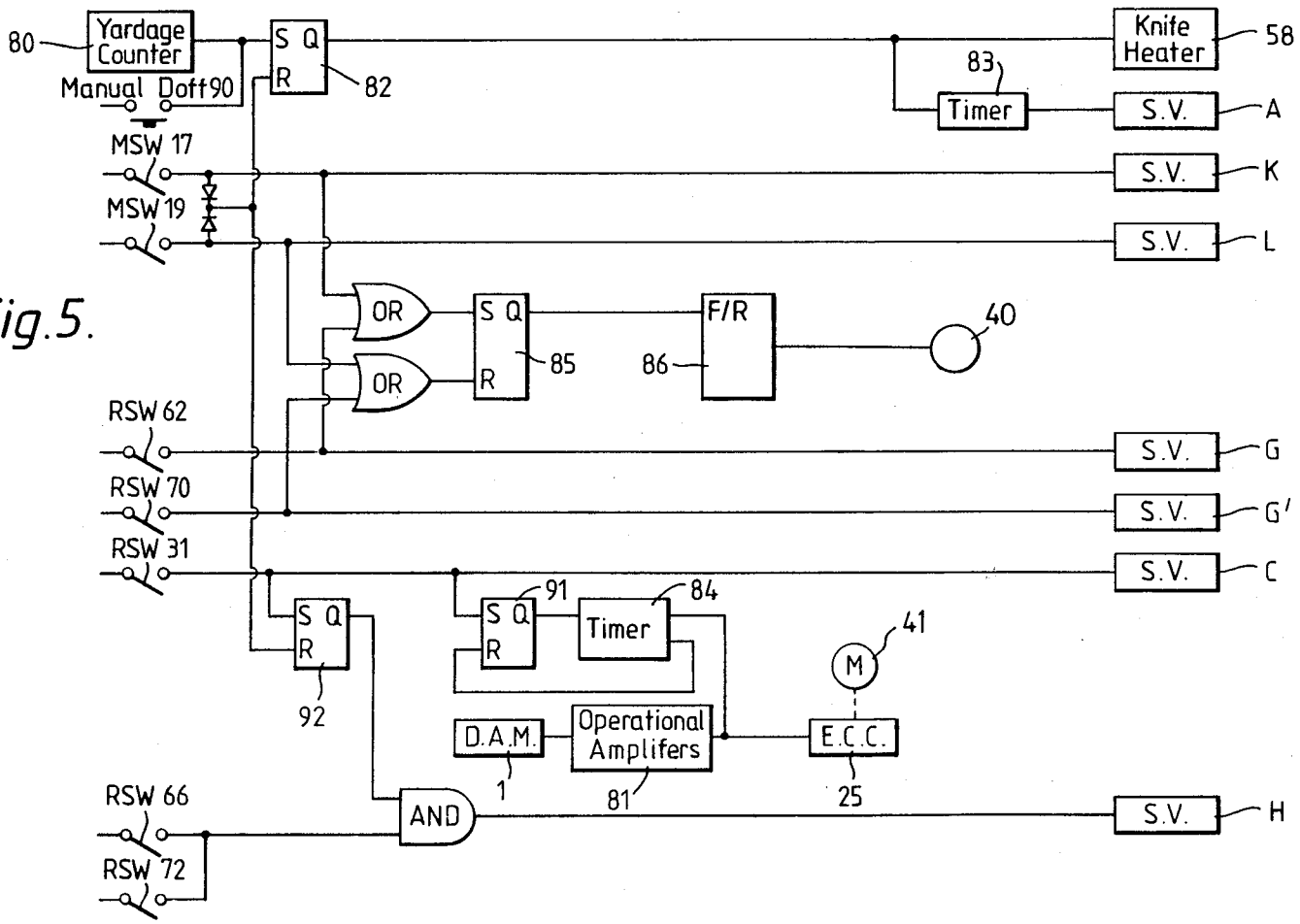
FIG. 5 is a schematic layout of a second part of the circuit.

The spindles 16 and 44 are driven from a motor 41 illustrated only in FIG. 5, through a torque-controlled variable speed eddy current coupling 25 and drive belts 50, 52, the belts 52 engaging belt wheels 54 attached to the end of the spindles 16 and 44.

When the required yardage for the bobbin 10 has been reached a conventional yardage counter 80, shown in circuit diagrams FIGS. 4 and 5, sends a signal through the electric/pneumatic control box 56 which is described in greater detail with reference to FIGS. 4 and 5, to a concave-shaped heating element 58 of a yarn severing device 60 so as to pre-heat the filament severing device in anticipation of the transfer of the yarn 22 from the bobbin 10 to the bobbin 42.

A circuit in the control box 56 also then transmits a signal to admit air to the cylinder 30. The lever 32 of the bar 27 then pivots the bar upwardly until it lifts the guide fingers 18, 20 together with the threaded block 6 which pivots about its guide rod 7.

The yarn guide is lifted sufficiently high for the block 6 to disengage from the screw 4 and the fingers 18, 20 to clear the bobbin flanges 12', 46'.

Figure 2:
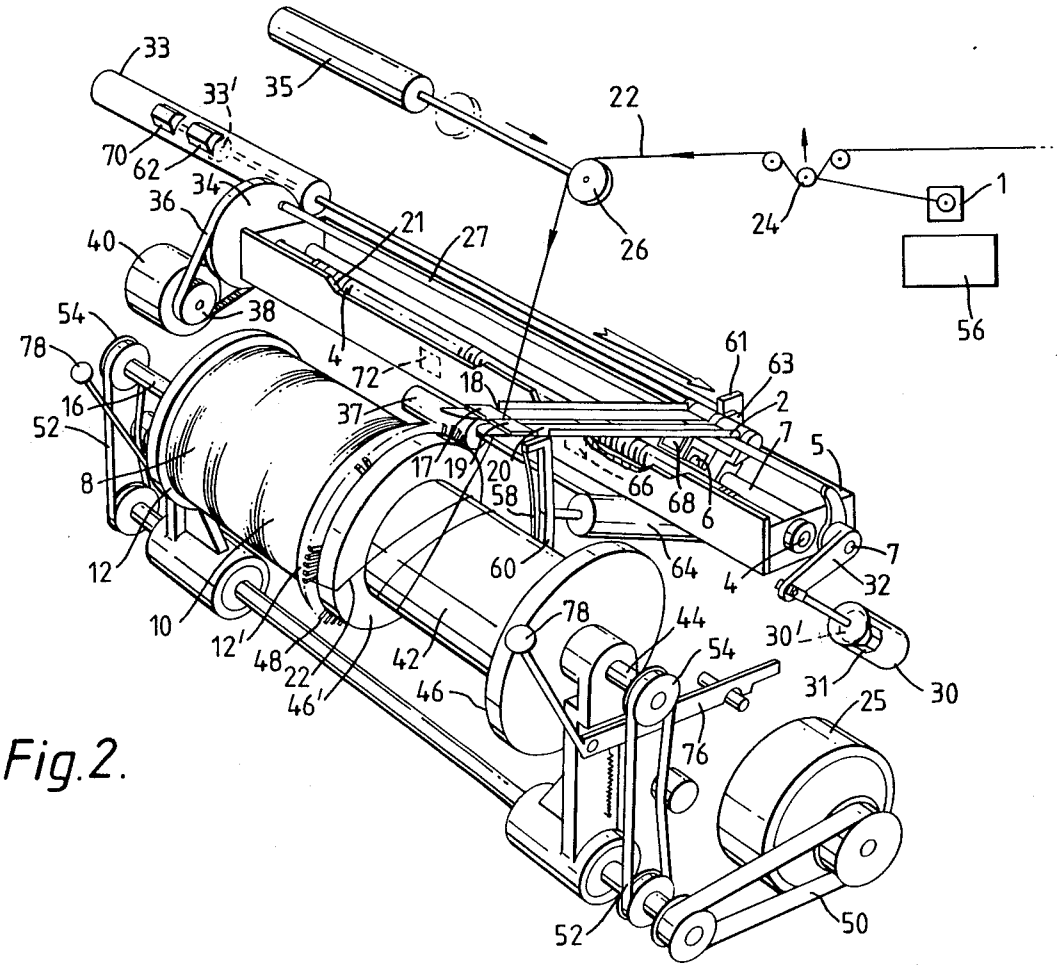
FIG. 2 is a view corresponding to FIG. 1 but showing the machine in a position in which the yarn has been transferred for winding onto a second relatively empty bobbin.

When cylinder 30 is operated, a pusher device 61 which is also pneumatically driven by a cylinder 33, moves to the right along the back of the traverse box 5 as indicated by the arrow in FIG. 2 from an inoperative position as shown in FIG. 1 to the position shown in FIG. 2. During its movement it engages a tail member 63 which is positioned on the back of the block 6 and which is pivoted with that block so as to lie in the path of the pusher 61 (see FIG. 2). Thus the whole guide assembly is slid along the bar 7 to the right as seen in the drawings.

Simultaneously the yarn guide pulley 26 which, as shown in FIG. 1, is initially at a position lying above and centrally between the flanges 12 of the bobbin 10, is moved to the right by a cylinder 35 to take up a similar position above the bobbin 42 and the severing device 60 is moved by a cylinder 37 from a position in line with bobbin 10 close to flange 12' to a corresponding position close to flange 46 of bobbin 42.

The yarn filament 22 remains engaged between the fingers 18, 20 of the yarn guide and is thus transferred by those fingers from the full package on the bobbin 10 across adjacent bobbin flanges 12', 46' to the barrel of empty bobbin 42.

The yarn is thus laid between teeth of the rubber disc 48 which rotates with the bobbins so as to locate the yarn 22 in a proper position on the flange 46' as can clearly be seen in FIG. 2.

A magnetic reed switch 62 is positioned on the body of the cylinder 33, which is actuated by the passage nearby of the piston 33' which is formed of magnetic material so that when the magnetic piston 33' in cylinder 33 passes reed switch 62 this activates the solenoid valve G (FIGS. 4 and 5) to retract cylinder 30. Guide fingers 18, 20 then descend to the operative position relative to the barrel of bobbin 42 and block 6 re-meshes with screw 4. The position of reed switch 62 can be set to determine the angle that the yarn makes between the flange 46' an barrel of bobbin 42.

At transfer as illustrated in FIG. 2 the winding conditions for the filament change quite considerably because from being wound onto a full package having a diameter of, for example 250 mm, the filament is suddenly transferred to a barrel having a diameter of, for example, 120 mm. To compensate for this the torque of the eddy current coupling 25 is rapidly increased, resulting in an increase in the speed of rotation of both bobbins 42 and 10 so that the surface speed of the empty barrel 42 reaches the delivery speed of the yarn. In fact at this time it is best to allow the torque to increase sufficiently to ensure that the first few turns or windings on the barrel of the empty bobbin 42 which are wound in the direction of the yarn transfer, are wound under rather greater tension than during normal winding and this is maintained until those initial windings have been overlaid by the following windings as the guide moves back towards the flange of the empty bobbin adjacent to the full one so as to lock them against the barrel and hold the angled length of yarn extending from the flange to the barrel in position for severing.

In the preferable arrangement, as illustrated, a second signal derived from the reed switch 62 is used by the electrical pneumatic apparatus so that in addition to the yarn guide being lowered at the predetermined position along the bobbin barrel which is determined by the position of the switch 62, the screwed spindle is driven in a direction to cause the block 6 and hence the guide fingers always to be moved towards the flange 46' of the bobbin 42 which is positioned adjacent the flange 12' of the bobbin 10. In other words, the length of yarn filament stretching at an angle from the flange 46' to the barrel of the bobbin 42 and initial windings laid whilst the traverse guide fingers were in the raised position and moving to the right, as seen in FIG. 2, are securely held almost immediately by the turns of yarn laid onto the bobbin by the yarn guide after this has been lowered as it moves back towards flange 46' so as to overlap the initial windings and the base of the angled piece.

The length of filament to be severed is therefore held sufficiently taut and at a convenient angle by the teeth on the disc 48 and the overlapping of the initial turns of yarn laid on the barrel of the fresh bobbin.

Figure 3:
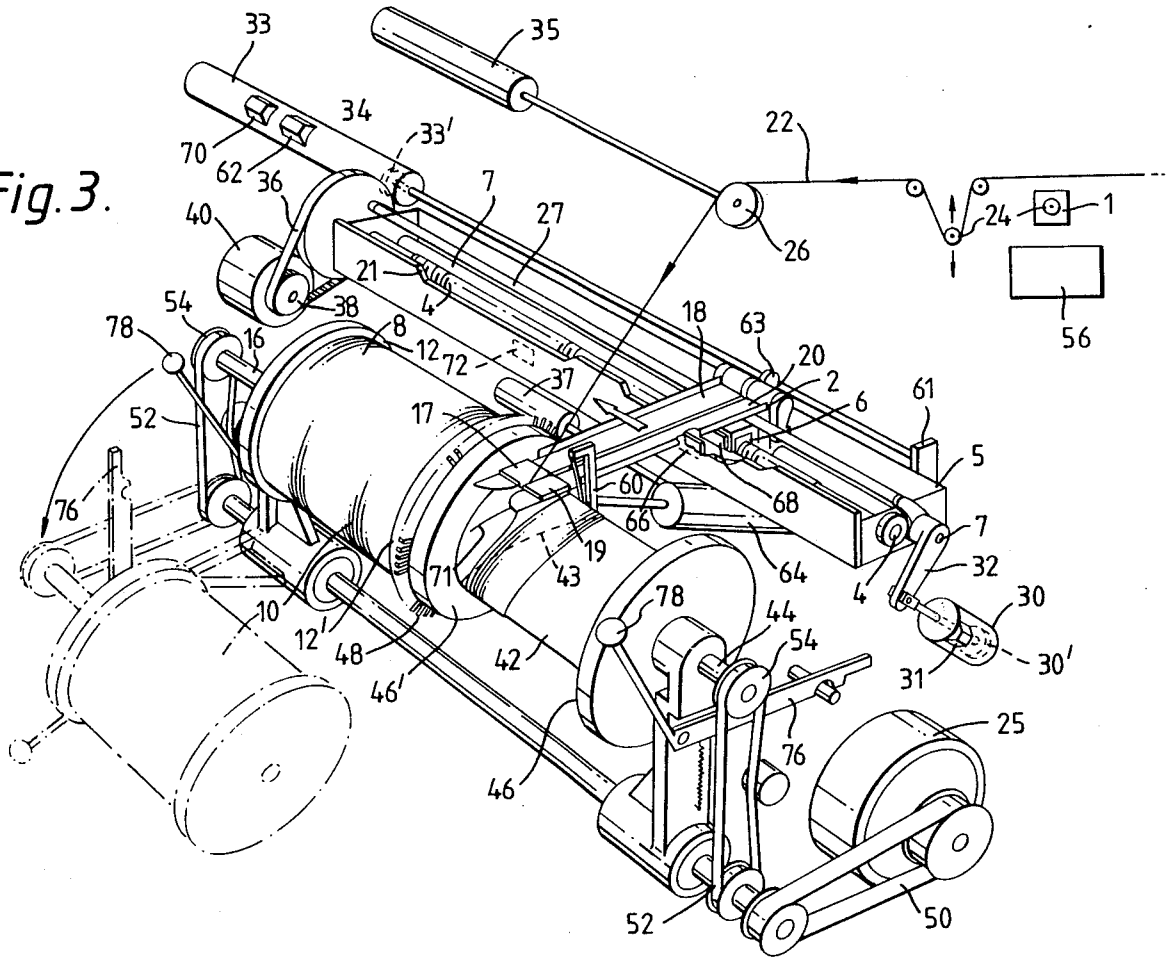
FIG. 3 is a view corresponding to FIGS. 1 and 2 showing the yarn being wound onto the second bobbin and illustrating the doffing of the first full bobbin.

The severing device, which, as already described, has been moved by cylinder 37 to be in line with the angled length of connecting yarn on the new bobbin 42, is moved towards the bobbin by a cylinder 64 controlled by a reed switch 66 located inside the traverse box 5, the switch being activated by magnet 68 on the block 6 as it moves to the left, as seen in FIG. 3, towards the flange 46' of bobbin 42. The forward movement of the severing device 60 causes the yarn to be engaged by the hot filament 58 which is concavely shaped so as to provide a relatively long period, or periods, of engagement with the yarn as the package rotates. The forward position at which the element is held during the severing operation is such that the yarn is not forced against the element with undue pressure but rather is allowed to stroke the element gently. It has been found that by this method, particularly when the yarn is a thermoplastic filament, it is severed quickly and cleanly. Forcing the filament against the element can result in the filament stretching instead of parting in a clean cut.

The length of time during which the severing device is held in the forward or operating position is dependent on the type and/or thickness of the filament being wound and/or the speed of rotation of the bobbin. Nevertheless, by the time the guide 20 reaches the flange 46', the filament has already been severed. The severing device 60 is then withdrawn by cylinder 64 to its inoperative position and the torque of the eddy current coupling 25 reduced to the requirement for normal winding and under the control of the dancing pulley 24.

It will thus be appreciated that the tail of yarn left on the new bobbin after severing, is kept to a manageable length and as the guide moves back to the left hand bobbin flange 46' as shown in FIG. 3, the initial windings are maintained tight around the barrel of the bobbin 42 and the tail is trapped and buried beneath the yarn as the yarn guide moves towards the flange of the bobbin adjacent the full bobbin.

The yarn will then continue to be laid on bobbin 42 under the control of the traverse mechanism until the yardage counter again initiates the same yarn transfer process except, of course, in the opposite direction, the reed switches 70 and 72 corresponding to switches 62, 66 operating at their appropriate times while their counterparts are rendered, and remain, inactive until required.

Electric/Pneumatic Controls

The electric/pneumatic control and operation of the mechanism will now be described with particular reference to the circuit diagrams of FIGS. 4 and 5.

With reference to FIG. 5 the winding spindles 16 and 44 are driven through a torque controlled eddy current coupling 25, the torque being controlled by signals from a photoelectric switch in a module 1 resulting from movement of the dancing pulley 24 (FIG. 1) as the package diameter increases during normal winding, the signals from the module 1 to the eddy current coupling being transmitted through amplifiers 81 to provide a current controlled output to the coupling.

The traverse screw 4 which drives the screwed block follower 6 so as to reciprocate the yarn guide 2 along the length of the barrel of the bobbin 10, 42, is driven by a motor 40. The direction of rotation of this motor is controlled by two micro switches 17, 19 located on the independently pivotable traverse guide fingers 18, 20, so as to operate when the respective finger constitutes the trailing finger, with respect to the direction of movement of the traverse guide, and is operated by engagement with the inside face of the bobbin flange towards which it is travelling. Operation of micro switch 17, 19 sends an electrical signal to the input terminals of a flip flop 85 the output of which is connected to the forward-/reverse direction input terminal on the drive 86 of motor 40. Operation of the micro switch 17 results in the transmission of a signal to the motor 40 to cause it and hence the screw 4 to rotate in a direction as to cause the traverse guide 2 to be driven to the left as seen in FIG. 1. Operation of micro switch 19 results in the motor 40 being reversed so as to drive the yarn guide to the right.

The transfer cycle of the yarn from the completed bobbin to the empty bobbin, which shall be referred to as the doffing cycle, commences on a signal from a yardage counter 80, when the bobbin has reached the predetermined size (or from a manually operated doff button 90), to a latch 82 which turns on knife heater 58. The signal also energises a solenoid valve "A" after a predetermined interval controlled by a timer 83. With reference to FIG. 4, on energisation of solenoid valve "A" air passes through the valve to open main valve "B", hence to operate cylinder 30 to pivot the lever 32 about guide rod 7 (as seen in FIG. 2) so as to pivot the yarn guide 2 upwardly sufficient to clear the bobbin flanges when it is moved laterally. In raising the yarn guide the attached screwed block follower 6 upon which the yarn guide 2 is pivoted, is also lifted out of driven engagement with the screw 4.

Figure 4:
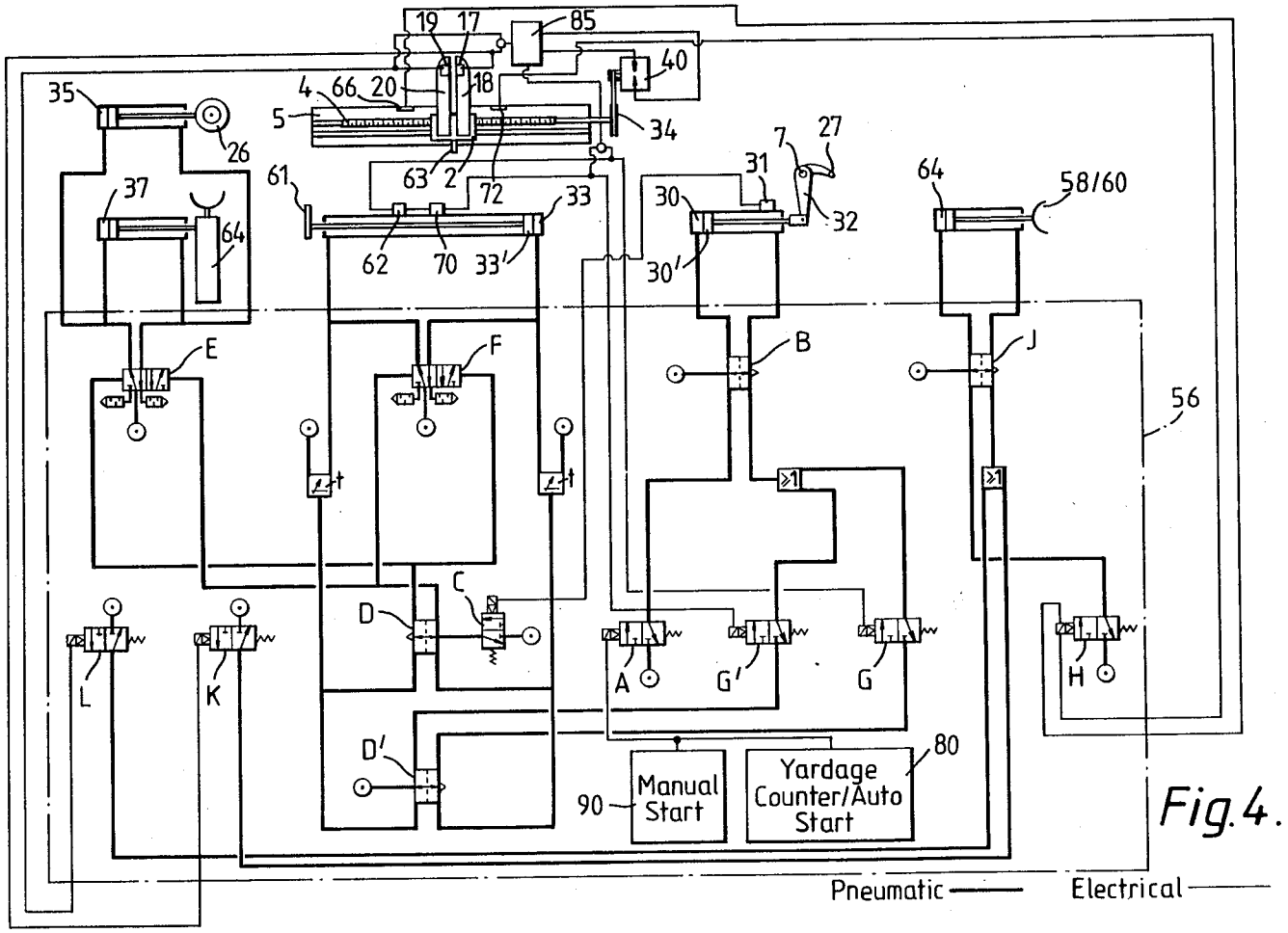
FIG. 4 is a a first part of a circuit diagram of an electric/pneumatic arrangement for use with the invention.

When the magnetic piston 30' of cylinder 30 reaches the end of its operative stroke the magnet closes the contacts in a reed switch 31 which virtually simultaneously signals the following operations:

(a) With reference to FIG. 4, solenoid valve "C" is energised passing air to mains valve "D" to open pilot valves "E" and "F". Valve "E" operates cylinders 35 and 37 extending their respective pistons to move yarn runner 26 and cylinder 64 which carries severing device 60 from their positions adjacent the full bobbin close to the flange adjacent the empty bobbin to a corresponding position relative to the flange of the empty bobbin adjacent the full bobbin, as seen in FIG. 2. Valve "F" extends the piston of cylinder 33 on the end of which is mounted pusher plate 61, so as to engage the tail member 63 of follower block 6, which because of the block being in a raised position causes the tail member to lie in the path of the pusher plate 61. This results in the block 6 being slid along the bar 7 so as to move the yarn guide 2 over the adjacent flanges of the full and empty bobbins to a position along the barrel of the empty bobbin, as shown in FIG. 2.

(b) With reference to FIG. 5, flip-flop 91 is set which, in turn, starts timer 84, the output from which gives a signal to the eddy current coupling 25 for a predetermined period so that, for that period, the torque of the eddy current coupling is rapidly increased. This increases the speed of the spindles 16 and 44 to compensate for the fact that the yarn is now being wound on the barrel of the empty bobbin which, of course, is smaller in diameter than that of the full package from which it is being transferred. The timer 84 is timed so as to signal the resetting of flip-flop 91 after the yarn is severed to return the control of the torque of the eddy current coupling 25 solely to the influence of the movement of the dancing arm module 1.

With reference to FIGS. 4 and 5, when the magnetic piston 33' in cylinder 33 passes one of reed switches 62, 70 (depending on the direction of yarn transfer, switch 62 being the switch operated when transfer is from left to right as seen in FIGS. 1 and 2) the switch sends a signal via an "OR" gate to set flip-flop 85, the output of which enables the drive 86 to ensure that the motor 40 is rotating in the direction that will drive the screw 4 to move the yarn guide 2 towards the flange of the empty bobbin which is adjacent to the full bobbin. Operation of the reed switch 62, 70, also energises solenoid valve G, G', which, in turn, changes flip-flop valve "B" passing air to retract piston 30' in cylinder 30, thus lowering the traverse guide 2 and its supporting follower 6 so that it engages with the screw 4 to move the yarn guide 2 towards the flange of the empty bobbin adjacent the full one, as seen in FIG. 3.

When the yarn traverse guide has travelled a predetermined distance towards the flange of the empty bobbin adjacent the full bobbin, the distance being determined by the lateral position of reed switch 66 or 72 (depending on the direction of yarn transfer) so as to wind the yarn around the barrel of the bobbin in that direction to trap the yarn which was laid while the yarn guide was being transferred from the full bobbin to the empty bobbin and leave a secured angled length of yarn extending from the flange to the barrel of the empty bobbin, the magnet 68 on the traverse guide follower 6 (FIG. 3) closes reed switch 66 or 72.

With reference to FIG. 5, reed switches 66, 72 are enabled only when flip-flop 92 is set. Flip-flop 92 is set when reed switch 31 is closed and reset by the next signal from micro switches 17 and 19 when the micro switch is operated by engagement with the inside face of the "bobbin flange". Operation of reed switch 66 or 72 energises solenoid valve H which passes air through flip-flop valve J so as to extend the piston of the cylinder 64 which carries the severing device 60 so that it moves into the path of the angled length of yarn held between the flange and barrel of the empty bobbin which rotates with the bobbin thus lightly brushing against the heated filament 58 of the severing device and being severed. The short length of tail of yarn left extending from the barrel is then overlapped as the yarn guide continues to move towards the bobbin flange.

When the micro switch 17 or 19 on the yarn guide is operated by engagement with the inside face of the empty bobbin flange adjacent to the full bobbin it transmits signals:

(i) to change the state of flip-flop 85 which passes through motor drive 86 to reverse the direction of motor 40 so as to drive the yarn guide towards the flange of the bobbin remote from the full bobbin;

(ii) to latch 82 so as to unlatch it to turn off the heater 58 of the yarn severing device 60;

(iii) to energise solenoid valve L:K thereby passing air through mains flip-flop valve J to piston 64 so as to retract the severing device to its inoperative position.

Modifications and Variations

Although in the preferred construction described above, the yarn guide is controlled to ensure that it will travel towards the flange of the empty bobbin adjacent to the full one almost immediately after the yarn has been transferred to the barrel of the empty bobbin, as an alternative the yarn guide may continue to travel in the direction of yarn transfer. If desired, right up to the flange of the empty bobbin remote from the full one provided that the increased torque drive to the winding spindle is maintained until the yarn guide has reversed and returned towards the flange of the empty bobbin adjacent to the full one so that the yarn wound during that return movement overlaps and traps those windings around the barrel of the empty bobbin wound during transfer prior to the return travel of the guide.

During the normal winding of bobbin 42 the doffing of bobbin 10 may take place either manually or automatically. The drawings show a simple arrangement by way of example in which each of the spindle and bobbin assemblies is located in the winding position by a spring loaded pivotable lever 76 which when pivoted by the handle 78 permits the relevant bobbin to drop forwardly as shown in dotted lines in FIG. 3. The full bobbin is then removed from its spindle 16 and replaced by an empty one before being relocated in the winding position alongside the bobbin being wound.

The toothed disc 48 may be engaged for rotary movement by any convenient means to either of the inner flanges of bobbin 10 or 42 so that when that bobbin is being doffed the disc comes with it. The operator then removes the disc from the just filled bobbin and attaches it to the new bobbin before lifting the assembly back into the winding position. A disc having a brush around its periphery can be used as an alternative or in addition to the toothed disc.

Precise axial alignment of the bobbins during operation of the apparatus is not an essential requirement of the invention and some relative lateral separation thereof may be allowed for in the design and construction of the apparatus.

While the mechanism has been described and illustrated with particular reference to winding a monofilament yarn with which a heated severing device has been found to be very efficient, it will be appreciated that the apparatus may be used for the winding of other yarns and the severing device need not necessarily include a heated knife.

We claim:

1. In a yarn winding machine for alternately winding two bobbins at first and second winding positions in a continuous sequence, each bobbin having a barrel to receive yarn and a flange at each end of said barrel, a fully wound bobbin being replaced by an empty bobbin while an adjacent bobbin is being wound, said flanged bobbins being located adjacent one another in said first and second winding positions on substantially aligned axes, and said machine having drive means for rotating said bobbins, the improvement comprising a yarn guide connected to said machine, said yarn guide extending over that bobbin barrel being wound so as to guide the yarn onto that barrel and lay it progressively thereover, motion means connected with said yarn guide for moving said yarn guide along a linear path parallel to said bobbin's axis at each of said first and second positions, return means connected with said yarn guide at each of said first and second positions for reciprocating said yarn guide along said linear path between two axially spaced planes defined by a bobbin's flanges, transfer means engageable with said yarn guide for transferring said yarn guide from its reciprocal path along the length of a fully wound bobbin to its reciprocal path along the length of an adjacent empty bobbin while both bobbins are in rotation, the yarn being led from said full bobbin over the adjacent two flanges of said full and empty bobbins onto the barrel of said empty bobbin adjacent said flanges in a manner for forming a yarn tail on said empty bobbin, yarn severing means connected to said machine for cutting said yarn tail at a predetermined position adjacent said two adjacent flanges of said full and empty bobbins but between the flanges of said empty bobbin, and control means for controlling said yarn severing means so that said yarn tail is severed only after the first yarn turns on a said empty bobbin's barrel have been overlaid by later yarn turns resulting from reciprocal movement of said yarn guide.

2. An improvement as set forth in claim 1, said yarn severing means comprising cutting means operable in a plane generally parallel to and adjacent to said two flanges to cut said yarn tail on said empty bobbin, that cut being located in that yarn length where the yarn extends between the adjacent flange's rim and where it is overlaid on said barrel by said later turns, that yarn length extending at an angle to the cutting plane.

3. An improvement as set forth in claim 2, said yarn severing means comprising at least one concave-shaped heating element, said control means controlling movement of said heating element into the rotating path of the said yarn's angled portion, said yarn's angled portion thereby stroking said heating element so as to be severed by it without being excessively stressed.

4. An improvement as set forth in claim 1, said improvement further comprising retention means for holding the yarn led over said bobbins, adjacent flanges in a fixed location on said flanges until it has been severed.

5. An improvement as set forth in claim 4, said retention means comprising a toothed disc positioned between said bobbins' adjacent flanges, the teeth of said disc extending around and beyond the outer periphery of said flanges, said disc being mounted to rotate with a flange of at least one of said two bobbins.

6. An improvement as set forth in claim 1, said motion means comprising a reversing motor, a lead screw driven by said reversing motor, said lead screw being of a length to serve both winding positions, a dis-engageable threaded nut attached to said yarn guide, said nut normally engaging said lead screw, disengagement means for releasing said nut from said lead screw when said yarn guide is to be transferred from a wound bobbin to an empty bobbin, and for subsequently re-engaging said nut with said lead screw when the transfer is complete, and motor control means responsive to the transfer of said yarn guide from a wound bobbin to an empty bobbin for reversing the direction of said reversing motor when said yarn guide is positioned over said empty bobbin.

7. An improvement as set forth in claim 6, said improvement comprising lay down means connected with said yarn guide, said lay down means being operable to ensure that said yarn guide starts to lay yarn on said empty bobbin's barrel in a direction toward the empty bobbin's flange that is adjacent said wound bobbin, said lay down means including an electrical switch actuated by movement of said yarn guide from said wound bobbin to said empty bobbin and which causes said yarn guide to be lowered to its lower yarn laying position from a raised transfer position.

8. An improvement as set forth in claim 2, said yarn severing means comprising translation means for translating said severing means in a direction parallel to the transfer direction of said yarn guide means from an operable position adjacent one bobbin to a mirror image position adjacent the other bobbin.

9. An improvement as set forth in claim 1, said improvement comprising yarn control means which controls the path of yarn to said yarn guide, said yarn control means being displaceable between a position adjacent one bobbin to a corresponding position adjacent the other bobbin at substantially the same time as said yarn guide is transferred from said one bobbin to said other bobbin.

10. A yarn winding machine for alternately winding two bobbins at first and second positions in a continuous sequence, each bobbin having a barrel to receive yarn and a flange at each end of said barrel, a fully wound bobbin being replaced by an empty bobbin while an adjacent bobbin is being wound, said machine comprising substantially axially aligned spindles on which said bobbins are mounted end to end, spindle drive means connected to said spindles for rotating said bobbins, a yarn guide connected to said machine, said yarn guide extending over that bobbin barrel being wound so as to guide the yarn onto that barrel and lay it progressively thereover, motion means connected with said yarn guide for moving the yarn guide along a linear path parallel to said bobbin's axis at each of said first and second positions, return means connected with said yarn guide at each of said first and second positions for reciprocating said guide along said linear path between two axially spaced planes defined by a bobbin's flange, transfer means engageable with said yarn guide for transferring said yarn guide from its reciprocal path along the length of a fully wound bobbin to its reciprocal path along the length of an adjacent empty bobbin while both bobbins are in rotation, the yarn being led from said full bobbin over the adjacent two flanges of said full and empty bobbins onto the barrel of said empty bobbin adjacent said flanges in a manner for forming a yarn tail on said empty bobbin, yarn severing means connected to said machine for cutting said yarn tail at a predetermined position adjacent said two adjacent flanges of said full and empty bobbins but between the flanges of said empty bobbin, first control means for controlling said yarn severing means so that said yarn tail is cut only after the first yarn turns on said empty bobbin's barrel have been overlaid by later yarn turns resulting from reciprocal movement of said yarn guide, first yarn tensioning means connected with said spindle, said first tensioning means cooperating with the yarn as it moves from a supply source to that bobbin being wound for controlling the speed of that bobbin's spindle so as to maintain tension on the yarn being wound within predetermined limits, second control means for controlling said transfer means, said second control means being responsive to a predetermined quantity of yarn wound on a full bobbin to cause the transfer of said yarn guide to an empty bobbin, and second yarn tensioning means connected with said spindles, said second tensioning means being operable to adjust the rotation speed of an empty bobbin so as to increase tension in the yarn until such time as said yarn guide moves axially over said empty bobbin's barrel to a position adjacent that empty bobbin's flange which is next to said wound bobbin.

11. A yarn winding machine as set forth in claim 10, said second tensioning means being operable to maintain increased tension in the yarn until said yarn tail is severed by said severing means.

12. A textile yarn winder comprising two substantially axially aligned rotatable bobbins, each bobbin being defined by a barrel mounted between two end flanges, a yarn guide operatively connected with said bobbins, said yarn guide being reciprocable along the barrel length of each of said bobbins for winding yarn on said bobbins one at a time until each is filled, transfer means connected to said yarn guide for moving said yarn guide from its reciprocal path along the barrel length of a full bobbin to a reciprocal path along the barrel length of an adjacent empty bobbin when it is desired to transfer the yarn from said full bobbin to said empty bobbin, the yarn being led from the barrel of said full bobbin over adjacent flanges of said full and empty bobbins to a position along the barrel of said empty bobbin which is adjacent said flanges so that a connecting portion of the yarn extends at an angle between the outer edges of said flanges and said empty bobbin's barrel, lay down means connected with said yarn guide for causing said yarn guide, after transferring the yarn from said full bobbin to said empty bobbin, to lay yarn on said empty bobbin's barrel while moving toward that flange of said empty bobbin which is adjacent to that flange of said full bobbin over which the yarn has been led, and severing means connected with said machine, said severing means being oriented in a predetermined plane, generally parallel to and adjacent said empty barrel's flange for cutting the yarn within its angled portion, said severing means being movable in said plane between a storage position out of contact with said angled portion and a cutting position where it intercepts the rotating path of said angled portion of yarn and severs it as a consequence of the rotation of said empty bobbin.

13. A textile yarn winder as set forth in claim 12, said winder comprising retaining means connected to said machine for holding the yarn in position on the outer periphery of said full and empty bobbins, adjacent flanges during movement of said yarn guide from said full bobbin to said empty bobbin, said retaining means also holding the yarn in that position during the cutting of the yarn's angled portion.

14. A textile yarn winder as set forth in claim 13, said retaining means comprising a circular member positioned between the two adjacent flanges of said full and empty bobbins, said member's periphery extending around and beyond the periphery of said bobbins' flanges, said member being mounted for rotation with one of said bobbins, and circumferentially extending yarn gripping means mounted on said circular member.

15. A textile yarn winder as set forth in claim 12, said lay down means comprising a yarn guide lowering device actuated by movement of said yarn guide from said full bobbin to said empty bobbin, said lowering device causing said yarn guide to lower into its yarn laying position from its raised transfer position.

16. A textile yarn winder as set forth in claim 12, said severing means comprising at least one concave-shaped heating element.

17. A textile yarn winder as set forth in claim 16, said severing means comprising a drive mechanism for moving said concave-shaped heating element toward the barrel of said empty bobbin so that the yarn's angle portion is stroked against said heating element without undue force in response to rotation of said empty bobbin.

* * * * *